United States Patent [19]

Shrum

[11] 4,174,624

[45] Nov. 20, 1979

[54] TANK FOR EXPLOSIVE FORMING

[76] Inventor: Lorne R. Shrum, 820 Manchester Rd., London, Ontario, Canada

[21] Appl. No.: 928,187

[22] Filed: Jul. 26, 1978

[30] Foreign Application Priority Data

Jul. 29, 1977 [CA] Canada ..... 283744

[51] Int. Cl.[2] ..... B21D 26/08

[52] U.S. Cl. ..... 72/56; 72/DIG. 27

[58] Field of Search ..... 72/56, DIG. 27; 29/421 E; 52/169.6, 169.7, 222, 232; 4/172.12

[56] References Cited

U.S. PATENT DOCUMENTS

| | | | |
|---|---|---|---|
| 3,126,623 | 3/1964 | Merrill | 72/56 X |
| 3,160,952 | 12/1964 | Corney et al. | 72/56 X |
| 3,214,950 | 11/1965 | Nemitz | 72/56 |
| 3,344,440 | 10/1962 | Lanyer | 4/172.12 |
| 3,373,464 | 3/1968 | Aunie | 4/172.12 X |
| 3,518,860 | 7/1970 | Dikhtovintov | 72/56 |
| 3,662,577 | 5/1972 | Pamiers | 72/56 |

OTHER PUBLICATIONS

"Explosive Forming of Metals", pp. 219–227, by Rinehart & Pearson, Publ. Pergamen Press 1963.

*Primary Examiner*—Leon Gilden

*Attorney, Agent, or Firm*—Ridout & Maybee

[57] ABSTRACT

A water-filled cylindrical tank is provided for explosive forming with improved means to damp ringing and to cushion shocks due to explosions within the tank. Damping is by means of an annular disc connected within the open top of the tank by rubber-in-shear mountings, and cushioning of the side wall of the tank is by means of a ring of vertical lengths of weighted hose.

5 Claims, 2 Drawing Figures

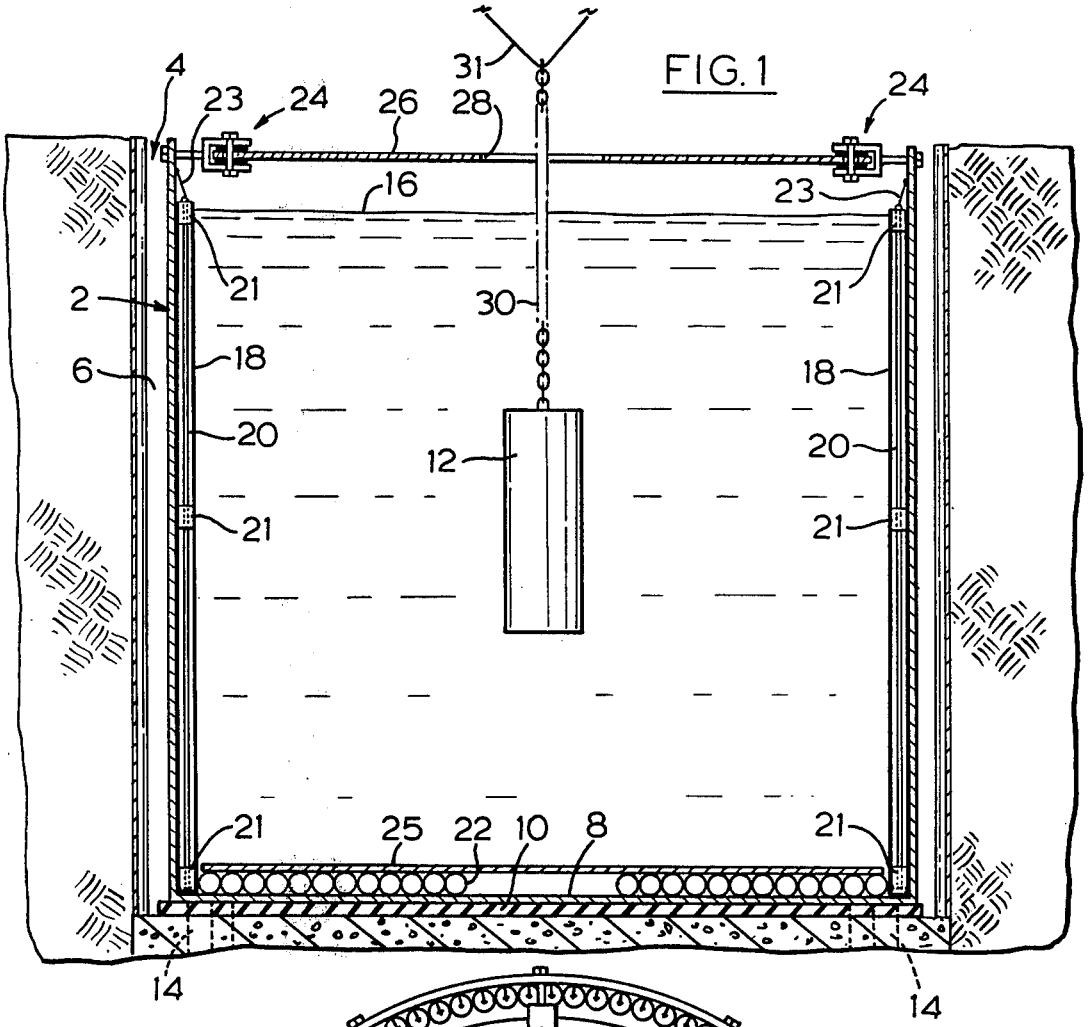
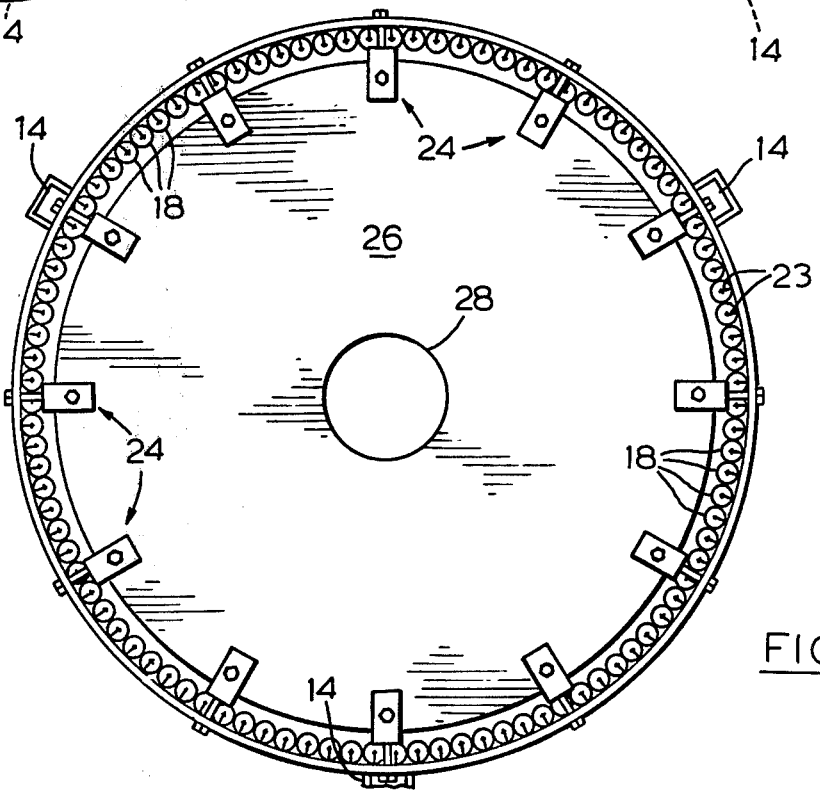
FIG. 2

TANK FOR EXPLOSIVE FORMING

FIELD OF THE INVENTION

This invention relates to explosive forming and more particularly to the water filled tanks in which many explosive forming techniques are carried out.

BACKGROUND OF THE INVENTION

Primary considerations in the design of such tanks are that they should be large enough for the water filling them to provide adequate containment for the explosive forces employed, that the structure should be able to withstand repeated applications of the explosive forces without damage, that the area adjacent the tank should be subjected to the minimum of noise and vibration, and that there be a minimum expulsion of water from the tank following an explosion.

In order to minimize the transmission of noise and vibration, designs of tank have been evolved in which the tank proper is sunk into a hole in the ground, with an air gap between the walls of the tank and the walls of the execavated hole. In order to protect the walls of the tank, the inner surfaces of the walls have been cushioned with air. In one method of producing this air cushion, both the bottom and side inner walls of the tank are lined by spiral coils of air filled hose. The substantial buoyancy of such hoses, and the considerable turbulence induced in the water by the explosions, makes it difficult to secure the coiled hose in situ against the side wall. Occasional leaks or damage to the hose are prone to occur, and any leak in the hose will disable the entire side wall protection. In another design, the side walls are protected by an annular curtain of air bubbles produced by discharging air from an annular sparge at the bottom of the tank. Although the air bubbles provide an effective cushion, a substantial air supply is required and also the air curtain tends to spread as it rises in the tank, thus reducing the effective capacity of the tank.

A further serious problem that can arise with these prior art tanks is that the application of explosive forces can cause the tank to "ring" like a bell with low frequency vibrations of high amplitude. This not only strains the tank structure but results in additional water being expelled violently upwardly from the tank. The top of the tank cannot be more than partially closed because of the necessity for allowing the explosion gases to escape.

SUMMARY OF THE INVENTION

According to the present invention, a tank for explosive forming comprises an open topped tank free-standing within a ground excavation, the tank being cylindrical about a vertical axis, and a horizontal annular plate located within the upper rim of the tank, the plate being spaced from and connected to said upper rim by a plurality of angularly spaced rubber-in-shear mountings. The disc so connected is found to damp vibration of the tank most effectively, whilst helping to supress expulsion of water from the tank. The central opening in the annular plate allows workpieces to be lowered into the tank, and this opening and the space between the edge of the plate and the rim of the tank permit explosion gases to escape readily. The plate provides a convenient working platform over the tank.

According to a further aspect of the invention, the submerged portion of the inner cylindrical wall of the tank is substantially covered by vertical lengths of air filled hose connected at their upper ends to the tank, each hose containing a straight longitudinal metal bar located axially within the hose of sufficient weight to give the hose negative buoyancy.

The hose arrangement described above is very easy to install since the hose lengths may merely rest on their bottom ends, the connections at their upper ends merely serving to keep them upright. Moreover, in the event of a leak or other damage to a hose length, the cushioning of the tank is not significantly reduced and the individual hose lengths are readily withdrawn and replaced.

SHORT DESCRIPTION OF THE DRAWINGS

FIG. 1 is a vertical section through a tank in accordance with the invention, and FIG. 2 is a plan view of the tank.

DESCRIPTION OF THE PREFERRED EMOBIDMENT

Referring to the drawings, a cylindrical open-topped steel tank 2 is installed in a steel (as shown) or concrete lined pit 4, a substantial air gap 6 being left between the side wall of the tank and the side wall of the pit. The base 8 of the tank rests on a rubber mat 10 laid on the concrete of the base of the pit. It is found that such a mat, typically about half an inch thick, provides sufficient insulation between the tank and the concrete when the workpiece 12 to be formed is suspended in the tank well clear of the bottom of the latter. However, better insulation could be achieved if necessary by supporting the tank on the concrete by means of rubber-in-shear mountings. In order to restrain the tank against any tendency to rotational or translational movement on its base, the base 8 is located by projections entering angularly spaced rubber mountings 14 set into the concrete around the base.

The size of the tank will obviously vary according to the size of the workpieces to be processed and the size of the explosive charges utilized. For workpieces with a maximum dimension not exceeding about three feet, and explosive charges not exceeding about a pound of PETN or equivalent, a tank twelve feet in diameter and twelve feet high, welded from half inch steel plate, is suitable.

Substantially the entire inner surface of the cylindrical side wall of the tank below the water level 16 is covered by a ring of vertically extending lengths of hose 18, the bottom ends of which rest on the bottom of the tank. Although it is not essential to obtain 100% coverage of the side wall, the protection afforded to the wall decreases rapidly as the percentage coverage decreases. The lengths of hose, which may typically be of ordinary 2.5 inch diameter industrial reinforced rubber hose, are plugged at top and bottom and fitted at their top ends with conventional inflation valves (not shown). Within and extending the length of each hose is a steel bar 20 of sufficient weight to give the inflated hose a negative buoyancy in water. For the size of hose referred to above, it is found that $\frac{3}{4}$ inch diameter steel reinforcing bar is ideal and also serves to hold the hose straight. The bar is located axially within the hose by winding collars 21 of foam rubber strip around the bars at spaced intervals before they are inserted in the hose lengths. The hoses are supported against the side wall of the tanks by cords 23 connecting their top plugs to studs within the upper rim of the tank, and thus may readily be withdrawn individually for repair or replacement.

At least the outer portions of the inner surface of the base of the tank are also covered with a coil of similar air filled hose 22, which is covered by a steel plate 25 of sufficient weight to overcome the buoyancy of the hose. A flexible pipe (not shown) connected to the hose 22 is taken up to the rim of the tank to enable the air pressure within the hose to be checked and adjusted if necessary. The air pressure in the various hoses is not critical, but should be at least amply sufficient to prevent collapse of the hoses under the hydrostatic pressure of the water within the tank. Although occasional leaks or damage may occur in individual hoses, occasional inflation checks will identify defective hoses so that these may be replaced.

In order to suppress ringing of the tank 2 after an explosion within it, a number, typically 12, of spaced points on the upper rim of the tank 2 are connected by rubber-in-shear mountings 24 to points on the periphery of a horizontal annular steel plate 26 coaxial with the tank and of diameter smaller than that of the tank, typically by about one foot in a 12 foot diameter tank. An aperture 28, typically about in the centre of the plate provides access for the lowering of the workpiece 12 into the tank and its removal after forming, and together with the gap around the periphery of the plate allows escape of explosion gases. In order to reduce wear and tear on the moulds and other equipment associated with the workpiece, and the hoist used to support the workpiece, suspension is preferably by means of a chain 30 supported from a nylon rope sling 31 which effectively suppresses the violent jerk which would otherwise accompany detonation of the explosive charge.

It is found that the spaced rubber-in-shear connections to the plate 26 provide extremely effective damping of any tendency on the part of the tank to ring, and to project water from the tank as a result of such ringing, whilst the plate 26 provides a very useful working platform over the top of the tank.

I claim:

1. A tank for explosive forming comprising an open topped tank cushionedly free-standing within a ground excavation, the tank being cylindrical about a vertical axis, and a substantially horizontal annular plate located within the upper rim of the tank, the plate being spaced from and connected to said upper rim by a plurality of rubber-in-shear mountings.

2. A tank according to claim 1, wherein the inner cylindrical wall of the tank is substantially covered by vertical lengths of inflated hose connected at their upper ends to the tank, the lengths of hose being weighted sufficiently to give them negative buoyancy in water filling the tank.

3. A tank according to claim 2, wherein the lengths of hose are weighted by means of straight metal bars extending longitudinally of the hoses and located axially therein.

4. A tank for explosive forming comprising open topped tank cushionedly free-standing within a ground excavation, the tank being cylindrical about a vertical axis and filled with water, wherein vertical lengths of inflated hose, connected at their upper ends to the tank wall substantially cover the inner cylindrical walls of the tank, the lengths of hose incorporating sufficent weighting to give them negative buoyancy in water.

5. A tank according to claim 4, wherein the bottom ends of the lengths of hose rest on the bottom of the tank.

* * * * *